US005790082A

United States Patent [19]

Podger

[11] Patent Number: 5,790,082

[45] Date of Patent: Aug. 4, 1998

[54] DOUBLE-DELTA LOG-PERIODIC ANTENNA

[76] Inventor: James Stanley Podger, 55 Gradwell Dr., Scarborough, Ontario M1M 2N1, Canada

[21] Appl. No.: 796,206

[22] Filed: Feb. 7, 1997

[30] Foreign Application Priority Data

Mar. 27, 1996 [CA] Canada ..... 2172742

[51] Int. Cl.[6] ..... H01Q 11/10

[52] U.S. Cl. ..... 343/792.5

[58] Field of Search ..... 343/700 MS, 741, 343/742, 792.5, 806, 793, 810, 812; H01Q 11/10, 19/28, 21/06

[56] References Cited

U.S. PATENT DOCUMENTS

| | | | |
|---|---|---|---|
| D. 213,375 | 2/1969 | Habig | D26/14 |
| 1,790,646 | 2/1931 | Alexanderson | 250/11 |
| 2,537,191 | 1/1951 | Moore | 250/33.67 |
| 2,615,005 | 10/1952 | White | 250/33.57 |
| 2,981,951 | 4/1961 | Wickersham et al. | 343/792.5 |
| 3,108,280 | 10/1963 | Mayes | 343/792.5 |
| 3,210,767 | 10/1965 | Isbell | 343/792.5 |
| 3,213,457 | 10/1965 | Carr | 343/792.5 |
| 3,268,899 | 8/1966 | Walden | 343/741 |
| 3,434,145 | 3/1969 | Wells | 343/726 |
| 4,152,706 | 5/1979 | Barbono et al. | 343/792.5 |
| 4,630,063 | 12/1986 | Kuo | 343/792.5 |
| 5,057,850 | 10/1991 | Kuo | 343/792.5 |

FOREIGN PATENT DOCUMENTS

| | | | |
|---|---|---|---|
| 62-206903 | 9/1987 | Japan | H01Q 19/28 |
| 63-138803 | 6/1988 | Japan | H01Q 7/00 |
| 806120 | 12/1958 | United Kingdom . | |

OTHER PUBLICATIONS

Grammer, George, "Technical Topics, The Quad Antenna," *QST*, Nov. 1948, pp. 40–42.

Sykes, B., "The Skeleton Slot Aerial System," *The Short Wave Magazine*, Jan. 1955, pp. 594–598.

Davey, W. W., "Try A Bi-Loop Antenna," *73 Magazine*, Apr. 1979, p. 58.

Hawker, J. Patrick, "Technical Topics, Double-Delta Aerials for VHF and UHF," *Radio Communications*, Jun. 1969, pp. 396–397.

Tsukiji, Takahiko and Shigefumi Tou, "High-Gain, Broad-Band Yagi-Uda Array Composed of Twin-Delta Loops," *Antennas and Propagation, Part I: Antennas*, I.E.E.E. Conference Publication No. 195, 1981, pp. 438–441.

Tsukiju, Takehiko et al, "Twin Delta Loop Antenna and Its Application to Antenna with Plane Reflector," *Electronics and Communications in Japan*, part 1, Vol. 68, No. 11, 1985, pp. 96–104.

Tsukiju, Takehiko and Yasunori Kumon, "The Crossed Twin-Delta-Loop-Antennas with Different Peripheral Lengths," *Proceedings of the 1985 International Symposium on Antennas and Propagation*, Japan, pp. 481–484.

(List continued on next page.)

*Primary Examiner*—Hoanganh T. Le
*Assistant Examiner*—Tho Phan

[57] ABSTRACT

This antenna has several sets of conductors attached to a pair of feeder conductors. Each set is two coplanar triangles with a corner from each triangle at the center and with the two triangle sides opposite those corners being positioned parallel to each other. Those sets of conductors are in parallel planes and are aligned so that the triangle sides in each set that are parallel to each other are also parallel to the similar parallel sides in the other sets. The dimensions of those sets of conductors and the spaces between those sets are progressively and proportionally smaller from the rear to the front of the antenna. Two feeder conductors are attached to the central corners of those sets of conductors in such a way that one conductor connects to one side of both triangles and the other conductor connects to the other side of both triangles. In addition, those connections are reversed between the adjacent sets. Finally, the connection to the associated electronic equipment is usually at the front end of those two feeder conductors. Such an antenna produces more gain in a particular antenna length than the more traditional log-periodic dipole antenna.

19 Claims, 3 Drawing Sheets

OTHER PUBLICATIONS

Belrose, John, "Technical Correspondence, A Half Twin–Delta Loop Array," *QST*, Apr. 1983, pp. 39–40.

Orr, William I., "Loop Configuration," *Radio Handbook*, 23rd ed. (Indianapolis: Howard W. Sams & Co., 1987), pp. 22–11/12.

Carrel, Robert L., *Analysis and Design of The Log–Periodic Dipole Antenna*, University of Illinois, Antenna Laboratory Technical Report 52.

Sykes, B., "The Skeleton Slot Antenna," *CQ*, Aug. 1960, pp. 52–53, 122.

Habig, Harry R, "The HRH Delta–Loop Beam," *QST*, Jan. 1969, pp. 26–29.

Prior Art
Fig. 2
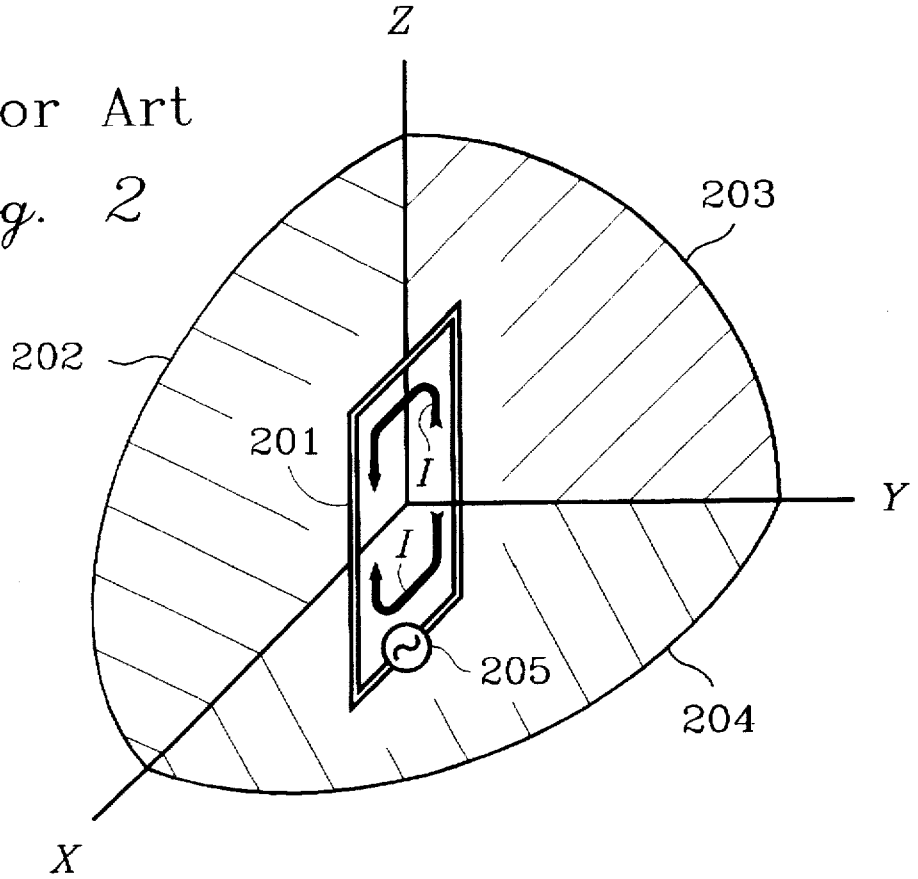
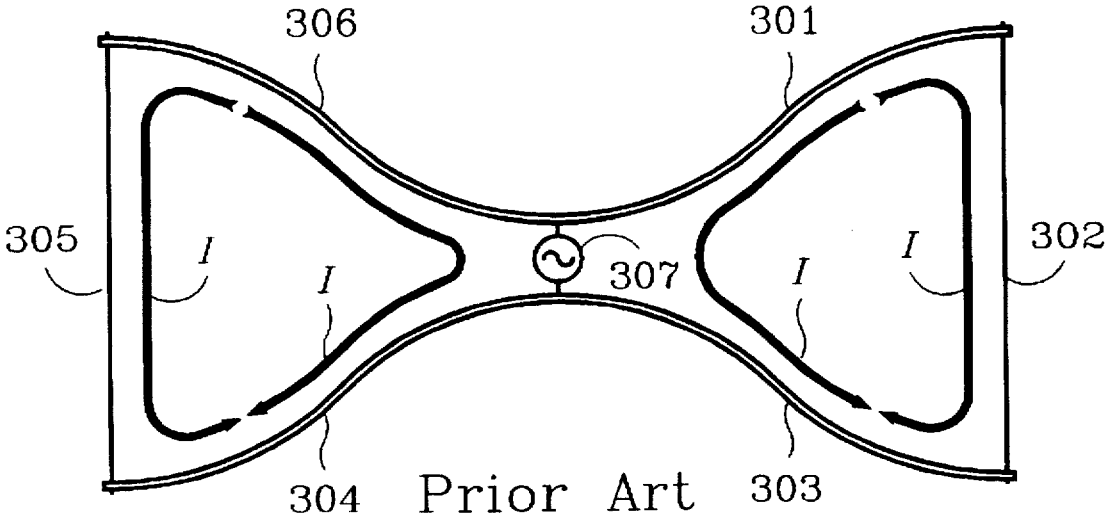
Prior Art
Fig. 3

DOUBLE-DELTA LOG-PERIODIC ANTENNA

This application is the U.S. version of Canadian patent application 1,172,742.

FIELD OF THE INVENTION

This invention relates to antennas, specifically antennas designed to operate over a wide band of frequencies. Heretofore, log-periodic arrays of half-wave dipoles have been a common choice for such service. Unfortunately, the amount of gain available from such arrays has been small considering their relatively large size. Particularly, they must be long from the front to the rear to produce high gains. This disclosure shows that more gain can be obtained from a particular antenna length by using pairs of triangular conductors instead of half-wave dipoles in such arrays.

LIST OF DRAWINGS

The background of this invention as well as the objects and advantages of this invention will be apparent from the following description and appended drawings, wherein:

FIG. 2 illustrates the conventional principal planes passing through a rectangular loop antenna;

FIG. 3 illustrates an antenna structure comprising two approximately triangular conductors with various construction features depicted.

PRIOR ART—ONE-WAVELENGTH LOOPS

Figure 1A:
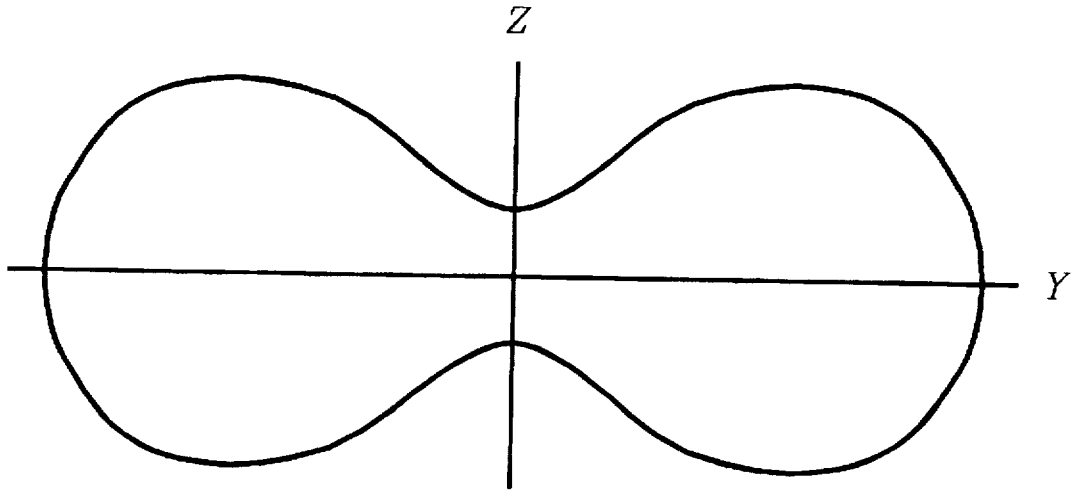
Prior Art Fig. 1A
FIGS. 1A, 1B and 1C illustrate some possible simplified radiation patterns of antennas.

Because this invention relates to antennas having pairs of triangular loops of conductors approximately one wavelength in perimeter, it is necessary to review the prior art of such loops. There is a need to understand the advantages of loops, the further advantages of pairs of loops, and the further advantages of pairs of triangular loops. Once the benefits of such loops are understood, it is easier to understand the merit of the present invention.

PRIOR ART—SINGLE LOOPS

The classical elementary antenna structure, called a half-wave dipole, is a straight conductor approximately one-half wavelength long. One of its disadvantages is that it transmits or receives equally well in all directions perpendicular to the conductor. That is, in the transmitting case, it does not have much gain because it wastes its ability to transmit in desired directions by sending signals in undesired directions. Another disadvantage is that it occupies considerable space from end-to-end, considering that its gain is low. A third disadvantage is that it is susceptible to receiving noise caused by precipitation. Yet another disadvantage is that if a high transmitter power is applied to it, in some climatic conditions, the very high voltages at the ends of the conductor can ionize the surrounding air producing corona discharges. These discharges can remove material from the conductor ends and, therefore, progressively shorten the conductors.

It was mainly this last disadvantage that was a problem for Clarence C. Moore at short-wave broadcasting station HCJB, near Quito, Ecuador. The solution he disclosed in his U.S. Pat. No. 2,537,191 was to use instead arrays of antenna structures consisting of square, rectangular or circular two-turn loops of conductors about one wavelength in perimeter. Although his patent was for two-turn loops, news of his invention stimulated interest in single-turn loops.

To illustrate the operation of one-wavelength, single-turn loops, FIG. 2 shows the rectangular version of them. In addition to the lines representing conductors, FIG. 2, as well as FIG. 3, has wide, solid arrows that denote some aspects of the currents in those parts. All of these arrows attempt to denote the current patterns as the standing waves vary from each null through the maximum to the following null in each electrical half-wave of the current paths. At the centers of these arrows, the currents would reach the maxima for the paths denoted by these particular arrows. Where the arrowheads or arrow tails face each other, there would be current nulls and the currents immediately on either side of these points would be flowing in opposite directions. However, beside these notations of where the current maxima and minima would be located, not much else is denoted by these arrows. Particularly, one should not assume that the currents at the centers of all the current paths are of the same magnitude and phase as each other even though all of these currents are denoted as I. In general, the interaction of the currents will produce a complicated amplitude and phase relationship between these currents. Nevertheless, it would be unusual if the phase of these currents would be more than 90 degrees away from the phase implied by the direction of the arrows. That is, the phase would not be so different from an implied zero degrees that the arrows should be pointed in the opposite direction because the phase is closer to 180 degrees than to zero degrees.

Of course, these current directions are just the directions of particular currents relative to the directions of other currents. They obviously are all alternating currents which change directions according to the frequency of operation.

As indicated by the generator symbol (205) in FIG. 2, if energy is fed into one side of the loop (201), maxima of current standing waves are produced at this feeding point and at the center of the opposite side of the loop, because it is a one-wavelength loop. The current minima and voltage maxima are half-way between these current maxima. Because the high-voltage points on such structures are not at conductor ends and the structures have lower Q's anyway, there are weaker electric fields around the high-voltage places and, therefore, less tendency to ionize the surrounding air.

Although this corona discharge usually is a problem only at high-altitude places, like Quito, the square, single-turn version of this antenna structure, commonly called a quad antenna, became popular for other reasons. First, the received precipitation noise is less with such loop antennas. Secondly, the radiation is not uniform in the YZ plane (203). This is because there are, in effect, two conductors carrying the maximum current, the top and bottom of the loop in FIG. 2, which are perpendicular to that plane. Although these two currents are approximately equal in amplitude and phase, because of the symmetry, their fields would add in phase only in the direction of the Y axis. Because the distances from those two conductors to any point on the Y axis are the same, the propagation delays are the same. In other directions, the distance travelled to any point would be different for the two fields, hence the fields would not add in phase. This nonuniformity is more pronounced if the loop is rectangular, instead of square, with the feed point in one of the shorter sides, as in FIG. 2. The result is that the radiation pattern in that plane is similar in shape to that illustrated by FIG. 1A. Hereinafter, this plane (203) will be called the principal H (magnetic field) plane, as is conventional.

Figure 1B:
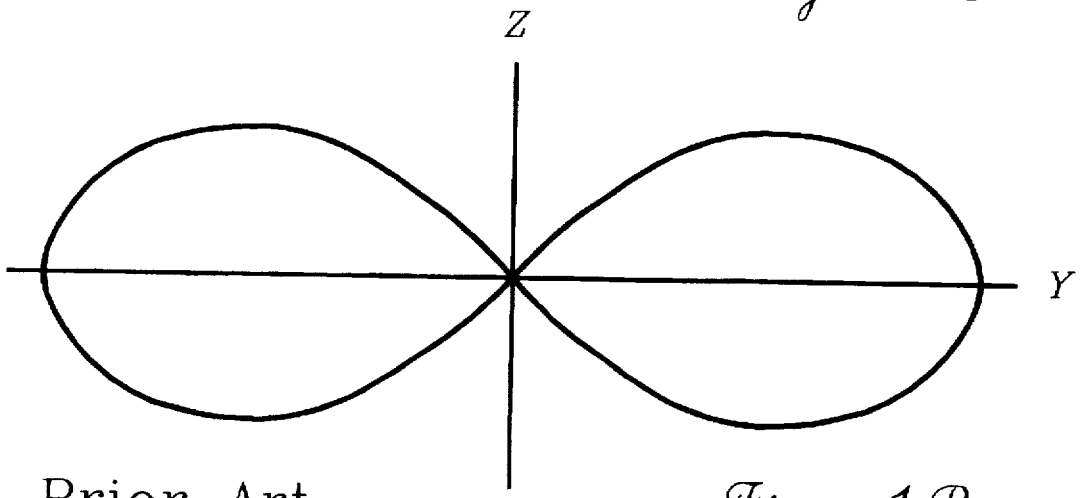
Prior Art Fig. 1B
Figure 1C:
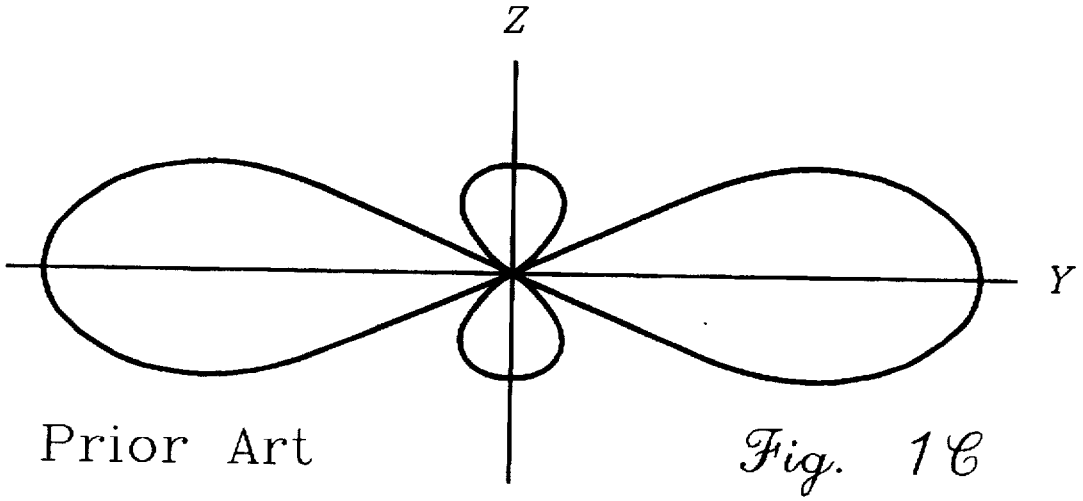
Prior Art Fig. 1C

Therefore, this structure has gain relative to a half-wave dipole antenna in the direction perpendicular to the plane of the loop, which is the Y axis of FIGS. 1 and 2. Also because of this nonuniform pattern, if plane 203 is vertical (horizontal polarization), signals transmitted at low angles to the horizon are somewhat stronger. This factor gave this antenna structure the reputation for being better if a high supporting tower was not available. That is because antennas located near the ground usually produce weak signals near the horizon.

This ability to produce stronger signals near the horizon is important in and above the very-high frequencies because signals generally arrive at angles near the ground. Fortunately, it is not difficult to put signals near the horizon at such frequencies because it is the height in terms of wavelengths that matters and, with such short wavelengths, antennas easily can be positioned several wavelengths above the ground. It also is important to put signals near the horizon at high frequencies because long-distance signals arrive at angles near the horizon and they usually are the weaker signals. This is more difficult to achieve because the longer wavelengths determine that antennas usually are close to the ground in terms of wavelengths.

Another advantage of this structure is that the quad antenna is only one-half as wide as the half-wave dipole antenna and, therefore, it can be placed in smaller spaces. On the other hand, because its high-current paths are shorter than those of a half-wave dipole, a quad produces a slightly broader radiation pattern in the plane that is perpendicular to both the plane of the antenna (202) and the principal H plane (203). Hereinafter, this will be called the principal E (electric field) plane (204), as is conventional. This broader pattern reduces the antenna gain to a relatively small extent. The net effect is that the quad does not have as much an advantage in satellite applications, where sheer gain may be most important, as it does in terrestrial applications, where performance at low elevation angles may be most important.

Since 1948, there have been many articles and books on the topic, such as George Grammer's article in QST in November, 1948. Other shapes of loops proposed include the triangle of J. D. Walden in U.S. Pat. No. 3,268,899, the better known delta loop of Harry R. Habig in U.S. design Pat. No. Des. 213,375, circles, and diamond-shaped loops. Mathematical analysis shows that the circular loops are the best of these shapes and the triangles are the worst. However, the differences are small.

PRIOR ART—PAIRS OF LOOPS

More significant advances have been made using closely spaced pairs of loops, without losing the advantages of single one-wavelength loops. Because of the interaction of the fields, these combinations of two loops modify the magnitude and phase of the currents to an extent that makes the combination more than just the sum of two loops. The result is that the dimensions can be chosen so that the field patterns in the principal H plane can be like FIG. 1B or even like FIG. 1C. Such dimensions not only give more gain by narrowing the major lobe of radiation but, particularly in the case of FIG. 1B, the radiation in undesired directions also can be greatly reduced. In addition, some arrays of such two-loop combinations can reduce the radiation to the rear to produce very desirable unidirectional radiation patterns in the principal H plane. On the high-frequency bands, such radiation patterns can reduce the strength of high-angle, short-distance signals being received so that low-angle, long-distance signals can be heard. For receiving weak very-high or ultra-high-frequency signals bounced off the moon, for another example, such patterns will reduce the noise received from the earth or from stars that are not near the direction of the moon. Also, for communications using vertical polarization on earth, so that the principal H plane is horizontal, such radiation patterns would reduce the interference from stations located in horizontal directions different from that of the desired station.

Perhaps the first of these combinations was two rectangular loops with a common side developed in the 1940's by B. Sykes. He discussed this combination in his article in *The Short Wave Magazine* in January, 1955. Later, the following three combinations of two loops were proposed by D. H. Wells in U.S. Pat. No. 3,434,145: two circles, two separate squares, and two squares with a common side. More recently, W. W. Davey's combination of two diamond-shaped loops, with a corner of each loop at the center of the structure, was described in his article in 73 *Magazine* in April, 1979. However, the most important combination seems to be John Pegler's pair of triangular loops, with one corner of each loop at the center, which was disclosed by Patrick Hawker in *Radio Communications* in Jun., 1969. Mr. Hawker reported that Mr. Pegler had used arrays of such structures for "some years" on amateur radio and broadcast television frequencies. Since Mr. Pegler called it a "double-delta" antenna structure, hereinafter that term will be used.

Among the various shapes that have been proposed, mathematical analysis shows that some of the rectangles of Sykes produce higher gains than the squares of Wells. Unfortunately, in order to produce radiation patterns like FIG. 1B from this type of structure, the necessary high and narrow structure yields good performance over a rather small range of frequencies. Much better performance is available from the diamonds of Davey, but best of all of these structures is the combination of two triangles proposed by Pegler. Although the diamonds give a slightly greater bandwidth for a particular gain than do the triangles, this advantage comes with disadvantages. Compared to the triangle structures, the diamond structures are larger between the outer corners, require one more connection between the parts of each loop because there are four sides, and do not suppress the radiation in undesired directions as well. Indeed, in order to obtain a pattern like FIG. 1B, the diamond structures must be much larger than the triangle structures. In addition, it is easier to adjust the triangles because a computer program can specify the dimensions with sufficient accuracy so that only the lengths of the two equal-length outer sides require adjustment on the antenna range.

PRIOR ART—PAIRS OF TRIANGLES

Specifically, Pegler's antenna is the combination having a corner of each triangle at the central point, with the sides of the triangles opposite those corners disposed parallel to each other to form the outer sides of the structure. FIG. 3 illustrates such an antenna, in a modified form. Hereinafter in this description and the attached claims, these outer conductors, 302 and 305, will be called the parallel conductors. Also, the remaining sides of the triangles, 301, 303, 304 and 306, will be called the diagonal conductors. The generator symbol, 307, implies that the structure is connected to the associated electronic equipment at the central point. Hereinafter in this description and the attached claims the term associated electronic equipment will refer to kind of equipment that is usually attached to antennas. In addition to transmitters and receivers, the associated electronic equipment could be devices such as security equipment that use antennas to detect the presence of objects.

Because of the symmetry of the structure in FIG. 3, it is apparent that the currents in the two parallel conductors would be approximately equal in amplitude and phase. Therefore, they would aid each other in producing a signal in the direction perpendicular to the plane of the loops. For FIG. 3, this would be a vertically polarized signal. One also can see that the vertical components of the currents in the diagonal conductors might aid this vertically polarized signal, but the extent of this aid is unclear because there is no reason to believe that the currents near the central point are equal in amplitude or phase to the outer currents. It is apparent from the symmetry only that the currents in the diagonal conductors of one triangle would be approximately equal in amplitude and phase to the currents in the corresponding diagonal conductors of the other triangle. One can be more confident in observing that the horizontally polarized components of the radiation in the direction perpendicular to the plane of the loops would tend to cancel. This is because the symmetry of the structure suggests that the horizontal components of the currents in corresponding parts of the two loops would be flowing in opposing directions. What the radiation might be in other directions is too complicated to perceive just from FIG. 3. That is, the current paths of FIG. 3 suggest only that the structure should favor vertically polarized signals in the direction perpendicular to the planes of the loops.

The gain advantage of these triangular loops seems to be based on the need to separate the high-current parts of the structure by a relatively large distance. As it is with combinations of dipoles, for example, there is a requirement to space individual antennas by some minimum distance in order to achieve the maximum gain from the combination. The spacing of the high-current parts achieved by the rectangular loops of Sykes and Wells is less than it could be because not only are the outer sides high-current active parts but so also is the central side. Davey's diamonds separate the high-current outer conductors to a greater degree, but that shape is not the best available. Triangular loops waste less of the available one-wavelength loop perimeter in placing the high-current outer conductors far from the central point. Triangular loops also greatly reduce the radiation from the central high currents because those currents are flowing in almost opposite directions into and out of the central corners. Therefore, as far as combinations of two loops approximately one wavelength in perimeter are concerned, these triangular shapes seem to produce the maximum gain available so far.

One modification of Pegler's antenna that is shown by FIG. 3 is that the diagonal conductors are curved. Although the Pegler version of this structure had straight diagonal conductors, mathematical analysis reveals that it is not a great change if they are curved by a moderate amount. Such curved diagonal conductors can produce right-angle connections between the various parts, which is often convenient. Of course, curved parts have more length than straight parts between the same points, so some adjustment will be needed in the length of the parts.

As is true of many antennas, double-delta antenna structures can be made using solid rods or tubing of almost any cross-sectional shape or diameter, although the circular cross-section is usually preferred. FIG. 3 somewhat illustrates this by showing the diagonal conductors as tubing and the parallel conductors as solid rods of a smaller diameter. One would expect that a large double-delta antenna structure designed for the high-frequency spectrum, for example, would have parts of various diameters because more strength would be required near the central supporting structure than would be required at the outer parallel conductors. For the ultra-high-frequency spectrum, the small structure needed could be constructed entirely of conductors of the same size.

The actual dimensions of such structures would depend on the cross-sectional dimensions of the conductors being used and, like most antennas, some adjustment would be necessary. However, some guidance can be obtained from the dimensions of one structure. In order to obtain a radiation pattern like FIG. 1B, one double-delta antenna structure had parallel conductors approximately 0.33 free-space wavelengths long and there was approximately 0.68 free-space wavelengths between the parallel conductors. For a pattern like FIG. 1A, the parallel conductors would be longer and the distance between the parallel conductors would be shorter. On the other hand, for a pattern like FIG. 1C, the parallel conductors would be shorter and the distance between the parallel conductors would be longer.

One also should note that although this structure appears superficially similar to a conical dipole, such as the one in Henry White's U. S. Pat. No. 2,615,005, the method of connecting it to the transmission line is radically different. The conical dipole is fed between one loop and the other loop. The double-delta antenna structure, and the other double-loop structures mentioned above, are fed between one side of both loops and the other side of both loops. This changes the current distribution and, therefore, the nature of the antennas.

Within many articles, Professor Takehiko Tsukiji and his colleagues at Fukuoka University have analyzed Pegler's antenna in, for example, Yagi-Uda arrays in I.E.E.E. Conference Publication 195 in 1981; in front of reflecting screens in *Electronics and Communications in Japan*, Vol. 68, No. 11, in 1985; and as parts of elliptically polarized arrays in the *Proceedings of The* 1985 *International Symposium on Antennas and Propagation*, in Japan. John Belrose disclosed the use of one-half of Pegler's antenna mounted on the ground in QST of April, 1983. One advantage of Pegler's antenna, as the Japanese researchers disclosed in their articles, is greater bandwidth as far as the terminal impedance is concerned. They also revealed the superior gain of such antennas if they are narrow and high instead of wide and short. Unfortunately, as is typical of antennas, the increased gain is accompanied by less bandwidth.

THE PRESENT INVENTION

Now that the prior art and merit of double-delta antenna structures has been disclosed, a particular new use of these superior structures can be disclosed. These antenna structures generally can be used in the way that half-wave dipoles are used, and Tsukiji and Belrose have disclosed some of the uses. The present disclosure is the application of such superior double-delta antenna structures to log-periodic arrays similar to the log-periodic dipole antenna disclosed by Isbell in his U.S. Pat. No. 3,210,767. Hereinafter, that combination will be called a double-delta log-periodic antenna. Log-periodic arrays of half-wave dipoles are used in wide-band applications for military and amateur radio purposes and for the reception of television broadcasting. The merit of such arrays is a relatively constant impedance at the terminals and a reasonable radiation pattern across the design frequency range. However, this is obtained at the expense of gain. That is, their gain is poor compared to narrow band arrays of similar lengths. Although one would expect that gain must be traded for bandwidth in any antenna, it is nevertheless disappointing to learn of the low gain of such relatively large arrays.

If one observes the radiation pattern of a typical log-periodic dipole array in the principal E plane, it appears to be a reasonable pattern of an antenna of reasonable gain because the major lobe of radiation is reasonably narrow. However, the principal H plane shows a considerably wide major lobe that indicates poor gain. This poor performance in the principal H plane is, of course, caused by the use of half-wave dipoles. Because half-wave dipoles have circular radiation patterns in the principal H plane, they do not help the array to produce a narrow major lobe of radiation in that plane.

Mr. Pegler's double-delta antenna structures are well suited to improve the log-periodic array because they can be designed to suppress the radiation 90 degrees away from the center of the major lobe, as in FIG. 1B. That is, for a horizontally polarized log-periodic array, as in FIG. 4, the radiation upward and downward is suppressed. However, since the overall array of parts 401 to 436 produces double-delta antenna structures of various sizes, several of which are used at any particular frequency, it is overly optimistic to expect that the radiation from the array in those directions will be suppressed as well as it can be from a single double-delta antenna structure operating at one particular frequency. Nevertheless, the reduction of radiation in those directions and, consequently, the improvement in the gain can be very significant.

In such arrays that have double-delta antenna structures aligned from the front to the rear, one should remember that the principal radiating parts of the double-delta antenna structures, the parallel conductors, should preferably be aligned to point in the direction of the desired radiation, perpendicular to the planes of the individual structures. This is somewhat important to achieve the maximum gain, but more important to suppress radiation in undesired directions. Therefore, when the perimeters of double-delta antenna structures must be unequal, the double-delta antenna structure widths should ideally be chosen so that the heights are equal. That is usually not a problem with Yagi-Uda arrays. This is partly because only one double-delta antenna structure in the array is connected to the associated electronic equipment, and partly because the range of frequencies to be covered is usually small enough that there is not a great difference in the sizes of the various double-delta antenna structures in the array. Therefore, although it may be preferable and convenient to align the parallel conductors for electrical purposes, it is not a great problem if mechanical requirements make a slight misalignment preferable.

One reason why a double-delta log-periodic array presents a problem in this respect is because the purpose of log-periodic arrays is to cover a relatively large range of frequencies. Therefore, the range of dimensions is relatively large. It is not unusual for the resonant frequency of the largest structure in a log-periodic array to be one-half of the resonant frequency of the smallest structure. One result of this is that if one tries to achieve that range of resonant frequencies with a constant height, it is common that the appropriate height of the largest double-delta antenna structure in the array for a desirable radiation pattern at the lower frequencies will be larger than the perimeter of the smallest structure. Hence, such an equal height array would be practicable only if the range of frequencies covered was not very large.

Another reason for the problem is that all of the individual double-delta structures are connected in a log-periodic array. Therefore, the relationship between the impedances of the structures is important. The problem of equal-height log-periodic designs is that the impedances of high and narrow double-delta antenna structures are quite different from the impedances of short and wide versions. The design of the connecting system, which depends on those impedances, may be unduly complicated if these unequal impedances were taken into account. In addition, the design may be complicated by the fact that the radiation pattern changes if the ratio of the height to width is changed. Therefore, instead of using equal heights, it may be preferable to accept the poorer gain and poorer suppression of radiation to the rear resulting from the nonaligned parallel conductors in order to use double-delta antenna structures that are proportional to each other in height and width.

Sometimes, a compromise between the extremes of equal height and proportional dimensions is useful. For example, the resonant frequencies of adjacent double-delta antenna structures may conform to a constant ratio, the conventional scale factor, but the heights may conform to some other ratio, such as the square root of the scale factor.

Whether equal-height double-delta antenna structures or proportional dimensions are used, the design principles are similar to the traditional principles of log-periodic dipole arrays. However, the details would be different in some ways. The scale factor ($\tau$) and spacing factor ($\sigma$) are usually defined in terms of the dipole lengths, but there are no such lengths available if the individual structures are not half-wave dipoles. It is better to interpret the scale factor as the ratio of the resonant wavelengths of adjacent double-delta antenna structures. If the design was proportional, that would also be the ratio of any corresponding dimensions in the adjacent structures. For example, for the proportional array of FIG. 4, the scale factor would be the ratio of any dimension of the second largest structure formed by parts 425 to 430 divided by the corresponding dimension of the largest structure formed by parts 431 to 436. The spacing factor could be interpreted as the ratio of the individual space to the resonant wavelength of the larger of the two double-delta antenna structures adjacent to that space. For example, the spacing factor would be the ratio of the space between the two largest double-delta antenna structures to the resonant wavelength of the largest structure.

Some other standard factors may need more than reinterpretation. For example, since the impedances of double-delta antenna structures are not the same as the impedances of dipoles, the usual impedance calculations for log-periodic dipole antennas are not very useful. Also, since the antenna uses some double-delta antenna structures that are larger and some that are smaller than resonant structures at any particular operating frequency, the design must be extended to frequencies beyond the operating frequencies. For log-periodic dipole antennas, this is done by calculating a bandwidth of the active region, but there is no such calculation available for the double-delta log-periodic antenna. Since the criteria used for determining this bandwidth of the active region were quite arbitrary, it may not have satisfied all uses of log-periodic dipole antennas anyway.

Figure 4:
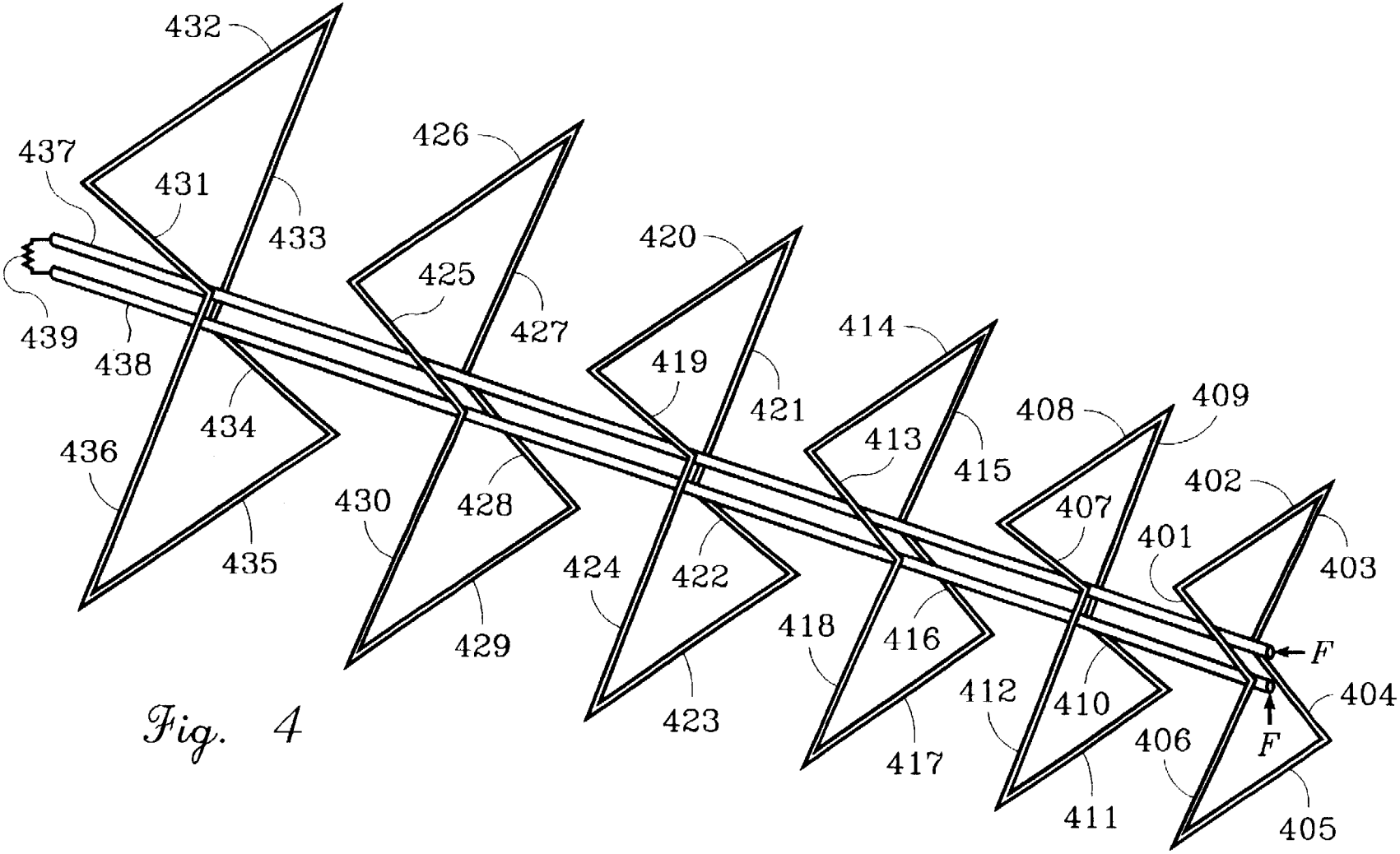
FIG. 4 illustrates a perspective view of the log-periodic array of pairs of triangular conductors, which is the subject of this disclosure.

However, if the array has a constant scale factor and a constant spacing factor, the structures are connected with a transmission line with a velocity of propagation near the speed of light, like open wire, and the connections are reversed between each pair of structures, the result will be a some kind of log-periodic array. In FIG. 4, that transmission line is formed by the two conductors 437 and 438. Hereinafter in this description and the attached claims, these conductors will be called the feeder conductors, as is fairly common practice. The connection reversal is achieved by alternately connecting the left and right sides of the double-delta antenna structures to the top and bottom transmission-line conductors. For example, the left side diagonal conductors of the largest structure, 431 and 436, are connected to the top conductor, 437, but the left side diagonal conductors of the second largest structure, 425 and 430, are connected to the bottom conductor, 438. The frequency range, the impedance, and the gain of such an array may not be what the particular application requires, but it will nevertheless be a log-periodic structure. The task is just to start with a reasonable trial design and to make adjustments to achieve an acceptable design.

The reason why this approach is practicable is because computer programs allow us to test antennas before they exist. No longer is it necessary to be able to calculate the dimensions with reasonable accuracy before an antenna must be made in the real world. The calculations can now be put into a computer spreadsheet, so the result of changes can be seen almost instantly. If the results of the calculations seem promising, an antenna simulating program can show whether the design is acceptable to a reasonable degree of accuracy.

POSSIBLE DESIGN TACTICS

To get a trial log-periodic design, the procedure may be as follows. What would be known is the band of frequencies to be covered, the desired gain, the desired suppression of radiation to the rear, the desired length of the array, and the number of double-delta antenna structures that could be tolerated because of the weight and cost. The first factors to be chosen would be the scale factor ($\tau$) and the spacing factor ($\sigma$). The scale factor should be rather high to obtain proper operation, but it is a matter of opinion how high it should be. Perhaps a value of 0.88 would be a reasonable minimum value. A higher value would produce more gain. The spacing factor has an optimum value for good standing wave ratios across the band, good suppression of the radiation to the rear, and a minimum number of double-delta antenna structures for a particular gain. Perhaps it is a good value to use to start the process.

$$\sigma_{opt}=0.2435\tau-0.052$$

Since the resonant frequencies of the largest and smallest double-delta antenna structures cannot be calculated yet, it is necessary to just choose a pair of frequencies that are reasonably beyond the actual operating frequencies. These chosen frequencies allow the calculation of the number (N) of double-delta antenna structures needed for a trial value of scale factor ($\tau$).

$$N=1+\log(f_{min}/f_{max})/\log(\tau)$$

Note that this value of N probably will not be an integer, which it obviously must be. The values chosen above must be changed to avoid fractional numbers of double-delta antenna structures.

The calculation of the length of the array requires the calculation of the wavelength of the largest double-delta antenna structure. This can, of course, be done in any units.

$$\lambda_{max}=9.84\times10^{8}/f_{min}\text{ft}$$

$$\lambda_{max}=3\times10^{8}/f_{min}\text{m}$$

The length will be in the same units as the maximum wavelength.

$$L=\lambda_{max}\sigma(1-f_{min}/f_{max})/(1-\tau)$$

Therefore, the input to the calculations could be $f_{min}$, $f_{max}$, $\tau$ and $\sigma$, and the desired results could be N and L. Using the optimum value of the spacing factor, the calculation usually would produce a design that was longer than was tolerable. If a longer length could be tolerated, the scale factor could be increased to obtain more gain. To reduce the length, the prudent action is usually to reduce the spacing factor, not the scal factor, because that will usually maintain a reasonable frequency independent performance.

Once a tolerable design is revealed by these calculations, they should be tested by an antenna simulating program. The largest double-delta antenna structure would be designed using the lowest design frequency ($f_{min}$). It would appear logical to design this structure to produce the radiation pattern of FIG. 1B in order to produce a desirable pattern in the principal H plane. However, experience indicates that a design closer to that of FIG. 1A tends to give a better H-plane pattern in log-periodic arrays. The dimensions of the remaining structures would be obtained by successively multiplying by the scale factor. The spaces between the structures would be obtained by multiplying the wavelength of the larger adjacent structure by the spacing factor.

An additional factor needed for the program would be the distance between the feeder conductors. For good operation this distance should produce a relatively high characteristic impedance. Unless the scale factor is rather high, a minimum characteristic impedance of 200 ohms is perhaps prudent for dipole arrays. Even higher characteristic impedances seem to be needed for double-delta log-periodic antennas.

The gain, front-to-back ratio, and standing wave ratio of this first trial probably would indicate that the upper and lower frequencies were not acceptable. At least, the spacing between the feeder conductors probably should be modified to produce the best impedance across the band of operating frequencies. Then new values would be entered into the calculations to get a second trial design.

What is an acceptable performance is, of course, a matter of individual requirements and individual standards. For that reason, variations from the original recommended practice are common. First, the optimum value of the spacing factor usually is not used in log-periodic dipole antennas because it would make the antennas too long.

Secondly, although the extension of the feeder conductors behind the largest double-delta antenna structure was recommended in early literature, it is seldom used. Ideally, it should be about an eighth of a wavelength long at the lowest frequency and terminated in the characteristic impedance of the feeder conductors, which is represented by the resistance symbol 439. It is more traditional practice to make the termination a short circuit. If the antenna is designed for proper operation, the current in the termination will be very small anyway, so the termination does very little and usually can be eliminated. Actually, extending or not extending the feeder conductors may not be the significant choice. There may be a limit to the length of the feeder conductors. In that case, the choice may be whether it is better to raise the spacing factor to use the whole available length to support the double-delta antenna structures or to spend a part of that available length for an extension.

Thirdly, the feeder conductors between the dipoles usually forms an open-wire line transposed between each pair of dipoles, as in the patent of Isbell. That is, the feeder conductors often do not have a constant spacing and, therefore, a constant impedance. Nevertheless, designs acceptable to some people are produced with these variations. Therefore, in view of this inexact common practice and with the superior performance in the principal H plane that is available, it is not very difficult to produce better log-periodic antennas using double-delta antenna structures.

The log-periodic array of FIG. 4 illustrates the appropriate connecting points, F, to serve a balanced transmission line leading to the associated electronic equipment. Other tactics for feeding unbalanced loads and higher impedance balanced loads are also used with log-periodic dipole antennas. Because these tactics depend only on some kind of log-periodic structure connected to two parallel tubes, these conventional tactics are as valid for such an array of double-delta antenna structures as they are for such arrays of half-wave dipoles.

Except for the restrictions of size, weight and cost, double-delta log-periodic antennas could be used for almost whatever purposes that antennas are used. Beside the obvious needs to communicate sound, pictures, data, etc., they also could be used for such purposes as radar or for detecting objects near them for security purposes.

While this invention has been described in detail, it is not restricted to the exact embodiments shown. These embodiments serve to illustrate some of the possible applications of the invention rather than to define the limitations of the invention.

I claim:

1. An antenna structure comprising a plurality of sets of conductors, such that:

(a) each of said sets of conductors has two approximately parallel conductors, disposed in approximately the same plane, and separated from the proximal point of said set of conductors by approximately equal distances;

(b) in each of said sets of conductors, the centers of said approximately parallel conductors and said proximal point are approximately aligned in the direction perpendicular to said approximately parallel conductors;

(c) in each of said sets of conductors, two diagonal conductors of approximately equal length, disposed in said plane, connect the ends of said approximately parallel conductors, on the same side of the set, to a connection point much nearer to said proximal point than the length of the operating wavelengths;

(d) in each of said sets of conductors, two more diagonal connectors of approximately the same length as the first pair of diagonal conductors, disposed in said plane, connect the other ends of said approximately parallel conductors to a second connection point much nearer to said proximal point than the length of the operating wavelengths, thereby producing two approximately triangular conductors;

(e) the dimensions of each of said sets of conductors and the manner of connection to the rest of said antenna structure are such that they produce current maxima approximately at the centers of said approximately parallel conductors and approximately at said proximal points, with single current minima between those maxima;

(f) the dimensions of each of said sets of conductors and the manner of connection to the rest of said antenna structure are such that the currents in said two approximately parallel conductors are approximately equal in amplitude and phase;

(g) the dimensions of each of said sets of conductors and the manner of connection to the rest of said antenna structure are such that the currents in the diagonal conductors of one approximately triangular conductor in each of said sets of conductors are approximately equal in amplitude and phase to the currents in the corresponding diagonal conductors of the other approximately triangular conductor;

(h) said sets of conductors are disposed in approximately parallel planes;

(i) said approximately parallel conductors of all said sets of conductors are approximately parallel to each other;

(j) said proximal points of said sets of conductors are aligned to point in approximately the direction perpendicular to said planes of said sets of conductors;

(k) the resonant frequencies of said sets of conductors are progressively and approximately proportionally higher from the rear to the front of said antenna structure;

(l) the distances between said sets of conductors are progressively and approximately proportionally shorter from the rear to the front of said antenna structure;

(m) the ratio of said resonant frequencies of each pair of adjacent sets of conductors and the ratio of the adjacent distances between said sets of conductors is approximately the same ratio;

(n) said sets of conductors are connected to each other by a pair of feeder conductors that connect to each of said connection points of said sets of conductors;

(o) said pair of feeder conductors is such that the phase relationship produced by the time taken for the energy to travel between the sets by that connection is approximately equal to that phase relationship which is consistent with travel at the speed of light;

(p) said pair of feeder conductors also produces, in addition to the phase difference caused by the travelling time of the energy, an additional phase reversal between said adjacent sets of conductors; and (q) the front ends of said pair of feeder conductors are connected to the associated electronic equipment.

2. The antenna structure of claim 1 wherein the differences in said resonant frequencies are caused by the dimensions of said sets of conductors approximately being proportionally larger or smaller.

3. The antenna structure of claim 1 wherein:

(a) the distances between said approximately parallel conductors of said sets of conductors are equal distances; and (b) the differences in said resonant frequencies are caused by the lengths of said approximately parallel conductors being different.

4. The antenna structure of claim 1 wherein the method of producing said resonant frequencies is a compromise between having all the dimensions proportional to each other and having the same distance between said approximately parallel conductors in each of said sets of conductors.

5. The antenna structure of claim 1 wherein said sets of conductors are designed to maximize the performance of said antenna structure in the direction perpendicular to said planes of said sets of conductors.

6. The antenna structure of claim 1 wherein said sets of conductors are designed to minimize the performance of the array in the direction in said planes of said sets of conductors that is perpendicular to said approximately parallel conductors.

7. The antenna structure of claim 1 wherein said sets of conductors achieve a beneficial compromise between producing the maximum performance of the array in the direction perpendicular to said planes of said sets of conductors and minimizing such performance in other directions.

8. The antenna structure of claim 1 wherein said approximately parallel conductors are approximately parallel to the ground.

9. The antenna structure of claim 1 wherein said approximately parallel conductors are approximately perpendicular to the ground.

10. The antenna structure of claim 1 wherein:

(a) said feeder conductors are approximately straight and;

(b) the phase reversal between said sets of conductors is accomplished by said two connection points being disposed so that they alternate between said adjacent sets of conductors.

11. The antenna structure of claim 1 wherein the phase reversal is accomplished by said feeder conductors crossing each other between said adjacent sets of conductors, without touching each other.

12. The antenna structure of claim 1, further including:

(a) a extension of said feeder conductors to a point approximately one-eighth of the lowest operating wavelength behind the largest set of conductors; and (b) a terminating component connected between said feeder conductors at their back ends.

13. The antenna structure of claim 1 wherein at least one of the conductors has an approximately circular cross-sectional area.

14. The antenna structure of claim 1 wherein at least one of the conductors has an approximately square cross-sectional area.

15. The antenna structure of claim 1 wherein at least one of the conductors has an approximately rectangular cross-sectional area.

16. The antenna structure of claim 1 wherein at least one of the conductors is a solid rod.

17. The antenna structure of claim 1 wherein at least one of the conductors is tubular.

18. The antenna structure of claim 1 wherein all the conductors have the same cross-sectional areas.

19. The antenna structure of claim 1 wherein the conductors do not have the same cross-sectional areas.

* * * * *